US012233305B2

(12) United States Patent
Wang

(10) Patent No.: US 12,233,305 B2
(45) Date of Patent: Feb. 25, 2025

(54) DUMBBELL CONVENIENT FOR ADJUSTING LOAD

(71) Applicant: ZHEJIANG KANGWANG INDUSTRY & TRADE CO., LTD, Zhejiang (CN)

(72) Inventor: Ping Wang, Zhejiang (CN)

(73) Assignee: ZHEJIANG KANGWANG INDUSTRY & TRADE CO., LTD, Jinhua (CN)

( * ) Notice: Subject to any disclaimer, the term of this patent is extended or adjusted under 35 U.S.C. 154(b) by 147 days.

(21) Appl. No.: 18/128,313

(22) Filed: Mar. 30, 2023

(65) Prior Publication Data

US 2023/0264067 A1 Aug. 24, 2023

Related U.S. Application Data

(63) Continuation of application No. PCT/CN2022/079524, filed on Mar. 7, 2022.

(30) Foreign Application Priority Data

Feb. 21, 2022 (CN) ..... 202220340927.X

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/00065; A63B 21/00069; A63B 21/062; A63B 21/0624; A63B 21/0626; A63B 21/0726; A63B 21/0728; A63B 21/075; A63B 71/0036; A63B 2225/09; A63B 2244/09
See application file for complete search history.

(56) References Cited

U.S. PATENT DOCUMENTS 6,228,003 B1 * 5/2001 Hald ..... A63B 21/075 482/107
6,261,022 B1 * 7/2001 Dalebout ..... A63B 21/075 482/107
6,416,446 B1 * 7/2002 Krull ..... A63B 21/0628 482/107

(Continued)

FOREIGN PATENT DOCUMENTS

CN 104162249 A 11/2014
CN 206350893 U * 7/2017

(Continued)

*Primary Examiner* — Gary D Urbiel Goldner

(57) ABSTRACT

The application relates to a dumbbell which is convenient for adjusting a load. By arranging telescopic sleeves which can be telescopically adjusted in a handle of the dumbbell, a number of counterweights nested on the telescopic sleeves is controlled, thus achieving an easy adjustment of the load. By arranging a rotatable knob, the telescopic sleeves inside the handle are driven to act through a gear transmission. Meanwhile, due to a position limitation of a division bar of the dumbbell, the counterweights nested on the telescopic sleeves are prevented from sliding left and right, thus ensuring a firm coupling.

7 Claims, 7 Drawing Sheets

(56) References Cited

U.S. PATENT DOCUMENTS

| | | | | |
|---|---|---|---|---|
| 7,887,469 | B1 * | 2/2011 | Chen | A63B 21/075 482/107 |
| 7,981,012 | B1 * | 7/2011 | Krull | A63B 21/0728 482/107 |
| 8,298,125 | B2 * | 10/2012 | Colledge | A63B 21/0728 482/107 |
| 11,007,397 | B2 * | 5/2021 | Liu | A63B 21/4035 |
| 11,167,167 | B1 | 11/2021 | Weng | |
| 11,285,354 | B1 * | 3/2022 | Tseng | A63B 21/0726 |
| 11,471,722 | B2 * | 10/2022 | Lu | A63B 21/075 |
| 11,745,044 | B2 * | 9/2023 | Zhou | A63B 21/0728 482/107 |
| 2004/0005968 | A1 * | 1/2004 | Crawford | A63B 21/0607 482/106 |
| 2004/0072661 | A1 * | 4/2004 | Krull | A63B 21/0728 482/106 |
| 2005/0079961 | A1 * | 4/2005 | Dalebout | A63B 21/0728 482/106 |
| 2007/0225132 | A1 | 9/2007 | Liu | |
| 2008/0070761 | A1 | 3/2008 | Lin | |
| 2009/0042700 | A1 * | 2/2009 | Liu | A63B 21/0728 482/107 |
| 2009/0197745 | A1 | 8/2009 | Olson | |
| 2013/0150217 | A1 | 6/2013 | Tang | |
| 2015/0360073 | A1 * | 12/2015 | Moran | A63B 21/075 |
| 2015/0367163 | A1 * | 12/2015 | Moran | A63B 71/0036 482/108 |
| 2016/0166873 | A1 * | 6/2016 | Liu | A63B 21/0726 482/107 |
| 2017/0001061 | A1 * | 1/2017 | Marjama | A63B 71/0036 |
| 2017/0239510 | A1 * | 8/2017 | Wang | A63B 21/0724 |
| 2020/0306578 | A1 * | 10/2020 | Pohl | A63B 21/0724 |
| 2020/0330813 | A1 * | 10/2020 | Liu | A63B 21/0728 |
| 2022/0096890 | A1 * | 3/2022 | Lu | A63B 21/0728 |
| 2022/0176186 | A1 * | 6/2022 | Chen | A63B 21/075 |
| 2022/0193482 | A1 * | 6/2022 | Wu | A63B 21/0726 |
| 2022/0347512 | A1 * | 11/2022 | Hong | A63B 21/0728 |
| 2022/0401785 | A1 * | 12/2022 | Gottehrer | A63B 21/0728 |
| 2023/0031956 | A1 * | 2/2023 | Luo | A63B 21/0726 |
| 2023/0181958 | A1 * | 6/2023 | Fu | A63B 71/0036 482/107 |

FOREIGN PATENT DOCUMENTS

| | | | | | |
|---|---|---|---|---|---|
| CN | 107998590 | A | * | 5/2018 | A63B 21/075 |
| CN | 107998591 | A | * | 5/2018 | A63B 21/075 |
| CN | 110292744 | A | * | 10/2019 | A63B 21/0726 |
| CN | 210044768 | U | | 2/2020 | |
| CN | 108969974 | B | * | 3/2020 | A63B 21/0726 |
| CN | 113144514 | A | | 7/2021 | |
| CN | 113713323 | A | | 11/2021 | |
| CN | 114028764 | A | * | 2/2022 | |
| CN | 217091919 | U | * | 8/2022 | A63B 21/0726 |
| CN | 218944251 | U | * | 5/2023 | |
| TW | 201438790 | A | * | 10/2014 | A63B 21/00065 |
| TW | 202100207 | A | * | 1/2021 | A63B 21/0726 |
| WO | WO-2023155252 | A1 | * | 8/2023 | A63B 21/0726 |

* cited by examiner

DUMBBELL CONVENIENT FOR ADJUSTING LOAD

CROSS REFERENCE TO RELATED APPLICATIONS

The present application is a Continuation Application of PCT Application No. PCT/CN2022/079524 filed on Mar. 7, 2022, which claims the benefit of Chinese Patent Application No. 202220340927.X filed on Feb. 21, 2022. All the above are hereby incorporated by reference in their entirety.

TECHNICAL FIELD

The application relates to the field of fitness equipment, in particular to a dumbbell convenient for adjusting load.

BACKGROUND OF THE INVENTION

With the advantages of small size and no sound during use, dumbbell is a common fitness equipment widely used and suitable for home environment. Conventional dumbbells have two types: fixed weight and adjustable weight, wherein a weight-adjustable dumbbell comprises a short handle, a plurality of dumbbell plates and a fixing structure for fixing the plates. To adjust the weight of a conventional adjustable dumbbell, it is necessary to detach the fixing structure first, then adjust the dumbbell plates, and finally replace the fixed structure. The whole process is rather tedious. On the other hand, in the process of weight training, dumbbells of different weights have to be tried before finding the most suitable one and the dumbbell needs to be disassembled repeatedly, which further puts extra inconvenience to the operation and leads to low weight change efficiency of conventional dumbbells. Therefore, a dumbbell convenient for adjusting load is desired.

SUMMARY OF THE INVENTION

The purpose of the application is to solve the defects in the prior art and provide a dumbbell which is convenient for adjusting the load.

In order to solve the problems, the application adopts the following scheme:

A dumbbell convenient for adjusting the load comprises two counterweight adjustment modules that are symmetrically arranged; the counterweight adjustment modules are connected through a handle; the counterweight adjustment modules are used for adjusting the weight;

The handle is hollow inside, and a connecting rod is arranged in the handle, which penetrates through the handle along the axis direction and extends out from both ends of the handle; the connecting rods extended are respectively connected with two counterweight adjusting modules.

Furthermore, the counterweight adjusting module comprises a casing, a transmission adjusting structure, telescopic sleeves and counterweights; wherein: the casing is arranged at both ends of the handle; the telescopic sleeves are on the connecting rod and can slide along the rod; the transmission adjusting structure is inside the casing, and is connected with the telescopic sleeves in the transmission way, for controlling the extension length of the telescopic sleeves.

Furthermore, a gap is provided between the inner wall of the handle and the connecting rod, served as the movement space for the telescopic sleeves.

Furthermore, the connecting rod is provided with two telescopic sleeves; an isolation ring is arranged between the two telescopic sleeves, which is fixed in the middle of the connecting rod; the periphery of the isolation ring is in contact with the inner wall of the handle; the outer diameter of the isolation ring is larger than that of the telescopic sleeves.

Furthermore, the counterweight is pie-shaped, with circular or equilateral polygonal edge; a U-shaped notch and a central opening are provided on the counterweight, and the notch passes through the central opening; the width of the notch is matched with the diameter of the connecting rod, and the notch is used for passing the connecting rod; the diameter of the central opening is matched with the outer diameter of the telescopic sleeves.

Furthermore, the notch of the counterweight is enlarged when approaching the edge, forming an opening structure shrinking from outside to inside.

Furthermore, the casing comprises an inner casing, an outer casing and a connecting casing; wherein the inner casing is sleeved with the two ends of the connecting rod near the handle, the outer casing is fixedly arranged at the two ends of the connecting rod, and the connecting casing is arranged between the inner casing and the outer casing to realize the fixed connection between them.

Furthermore, the transmission adjusting structure comprises a knob, a knob gear and a transmission gear; the knob is coaxially and fixedly connected with the knob gear; the transmission gear comprises the upper gear and the lower gear, wherein the upper gear engage with the knob gear and the lower gear is connected with the telescopic sleeve; a latch is arranged on one side of the telescopic sleeve close to the transmission gear for meshing with the lower gear of the transmission gear; the knob gear is connected with the inner casing through the mounting base I, the gear lever I of the knob gear passes through the mounting base I, and the knob gear is also fixedly connected with the knob through the gear lever I; the transmission gear is connected with the inner casing through the mounting base II, and the gear lever II of the transmission gear is mounted on the mounting base II.

Furthermore, the outer periphery of the gear lever I is provided with an arc protrusion at the position where the gear lever I passes through the inner casing; correspondingly, on the inner casing, a plurality of arc grooves are arranged on the side wall of the through hole through which the gear lever passes, and the shapes of the arc grooves are matched with the arc protrusion;

A spring is arranged between the gear lever I and the mounting base I;

A ball and a spring are arranged between the knob and the inner casing, and the lower surface of the knob is provided with a cylindrical opening for arranging the spring and locking the ball; the upper surface of the part where the knob is installed on the inner casing is provided with a plurality of ball grooves, and the positions of the arc grooves correspond to the arc grooves.

Furthermore, the connecting casing comprises a straight rod, which is used for connecting the inner casing and the outer casing; the straight rod passes through the opening on the outer casing and is in threaded connection with the inner casing;

The connecting casing also comprises a straight rod casing used for cladding the straight rod; the two ends of the straight rod casing are respectively connected with the inner casing and the outer casing;

The connecting casing also comprises a bottom connecting column, which and the straight rod are respectively arranged on the upper and lower sides of the connecting rod;

the two ends of the bottom connecting column are respectively connected with the inner casing and the outer casing;

Division bars are arranged on the straight rod casing and the bottom connecting column, which are used for dividing the counterweight nested on the telescopic sleeve.

The application has the following beneficial effects:

By arranging the telescopic sleeves that can be telescopically adjusted in the handle, the number of counterweight through which the telescopic sleeves pass can be controlled, so that the weight can be adjusted conveniently;

When the application is in use, adjust the knob in the transmission adjusting structure to drive the telescopic sleeve inside the handle to move telescopically; meanwhile, the division bar prevents the counterweight on the telescopic sleeve from sliding left or right, thus ensuring the firm coupling.

Figure 1:
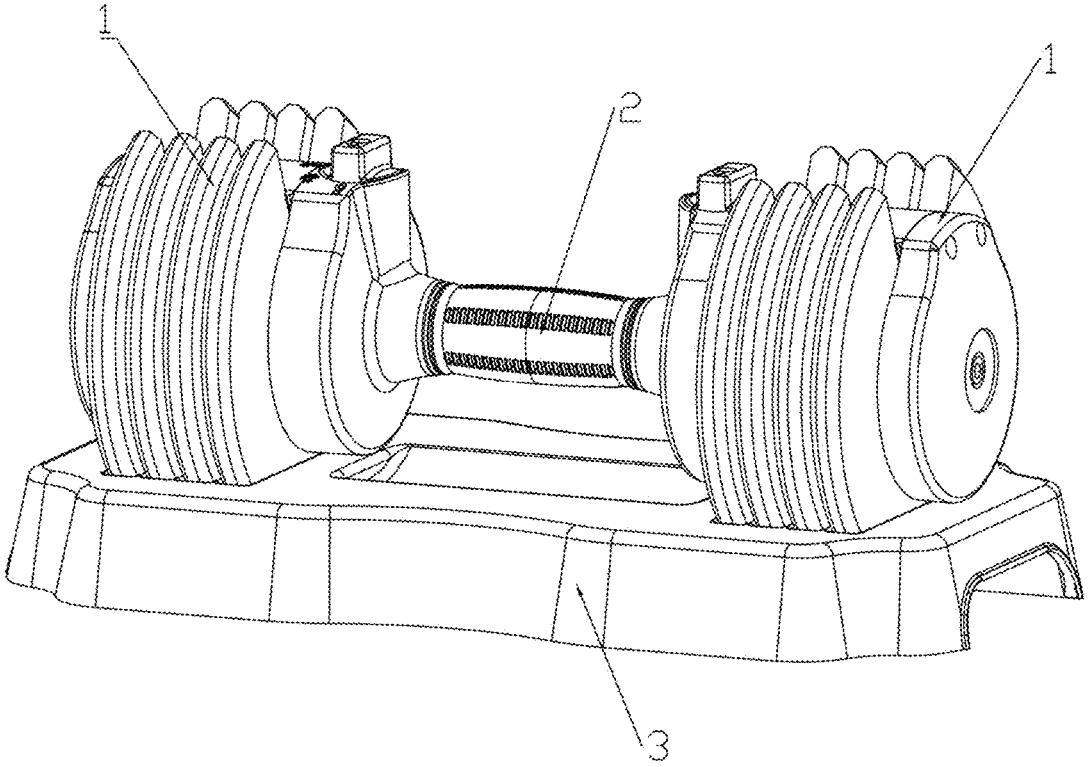
FIG. 1 is the overall schematic diagram in the Embodiment I of the application.

Description of the marks: counterweight adjusting module 1, casing 11, inner casing 12, mounting base I 121, mounting base II 122, arc-shaped groove 123, ball groove 124, outer casing 13, connecting casing 14, straight rod 141, straight rod casing 142, division bar 143, bottom connecting column 144, transmission adjusting structure 15, knob 151, knob gear 152, gear lever 1153, arc protrusion 154, transmission gear 155, gear lever 11156, telescopic sleeve 16, latch 161, counterweight 17, handle 2, connecting rod 21, isolation ring 22, seat 3.

DETAILED DESCRIPTION OF THE PREFERRED EMBODIMENT

The following specific embodiments illustrate the implementation of the application, and those skilled in the art can easily understand other advantages and effects of the application from the contents disclosed in this Specifications. The application can also be implemented or applied through other specific embodiments, and various details in this Specifications can be modified or changed based on different viewpoints and applications without deviating from the spirit of the application. It should be noted that without conflict, the following embodiments and characteristics in the embodiments can be combined with each other.

It should be noted that the illustrations provided in the following embodiments only illustrate the basic concept of the application in a schematic way. Therefore, only the components related to the application are shown in the drawings, instead of being drawn according to the number, shape and size of the components implemented. The types, numbers and proportions of each component in actual implementation may be changed at will, and the layout of the component may be more complicated.

Embodiment I

Figure 2:
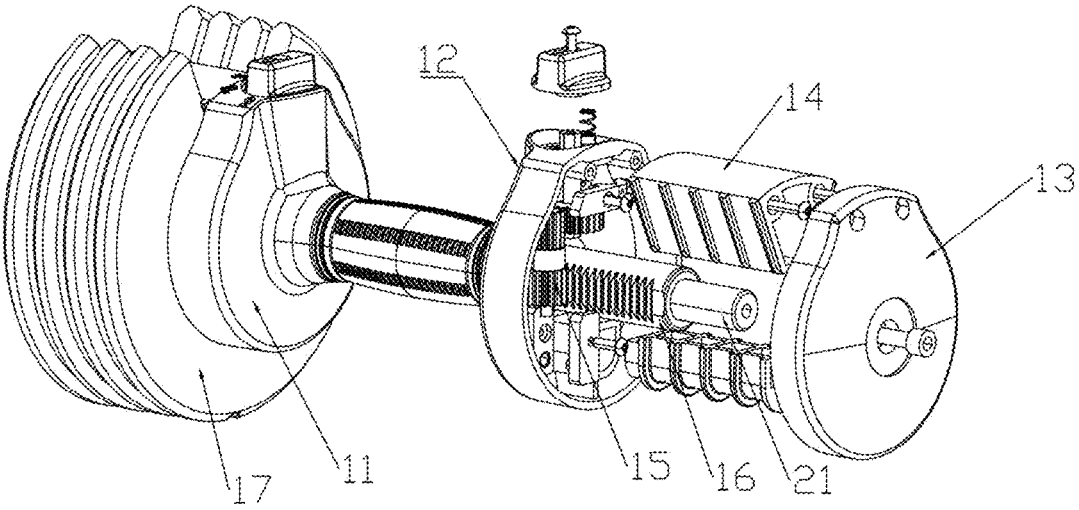
FIG. 2 is the exploded view of the counterweight adjusting module in the Embodiment I of the application.

As shown in FIG. 1, a dumbbell convenient for adjusting the load includes two counterweight adjustment modules that are symmetrically arranged; the counterweight adjustment modules 1 are connected through the handle 2; the weight of the counterweight adjustment modules 1 can be adjusted;

As shown in FIG. 2, the handle 2 is hollow inside, and a connecting rod 21 is arranged in the handle 2, which penetrates through the handle 2 along the axis direction and extends out from both ends of the handle 2; and the connecting rods 21 extended are respectively connected with two counterweight adjusting modules 1.

The counterweight adjusting module 1 comprises a casing 11, a transmission adjusting structure 15, telescopic sleeves 16 and counterweights 17, wherein the casing 11 is arranged at both ends of the handle 2; the telescopic sleeves 16 are arranged on the connecting rod 21 and can slide along the connecting rod 21. In this embodiment, a gap between the inner wall of the handle 2 and the connecting rod 21 is provided, so that when sliding along the connecting rod 21, the telescopic sleeves 16 can be housed in or extended out of the handle 2; the transmission adjusting structure 15 is arranged inside the casing 11, and is connected with the telescopic sleeves 16 in the transmission way for controlling the extension length of the telescopic sleeves 16. When the telescopic sleeves 16 extend out of the handle 2, as the telescopic sleeves 16 are sleeved outside the connecting rod 21, the radial cross-sectional diameter of the connecting rod 21 covered with the telescopic sleeves 16 can be increased, so that the counterweights 17 with the set gap width are clamped, and thus the counterweights can be adjusted.

Figure 3:
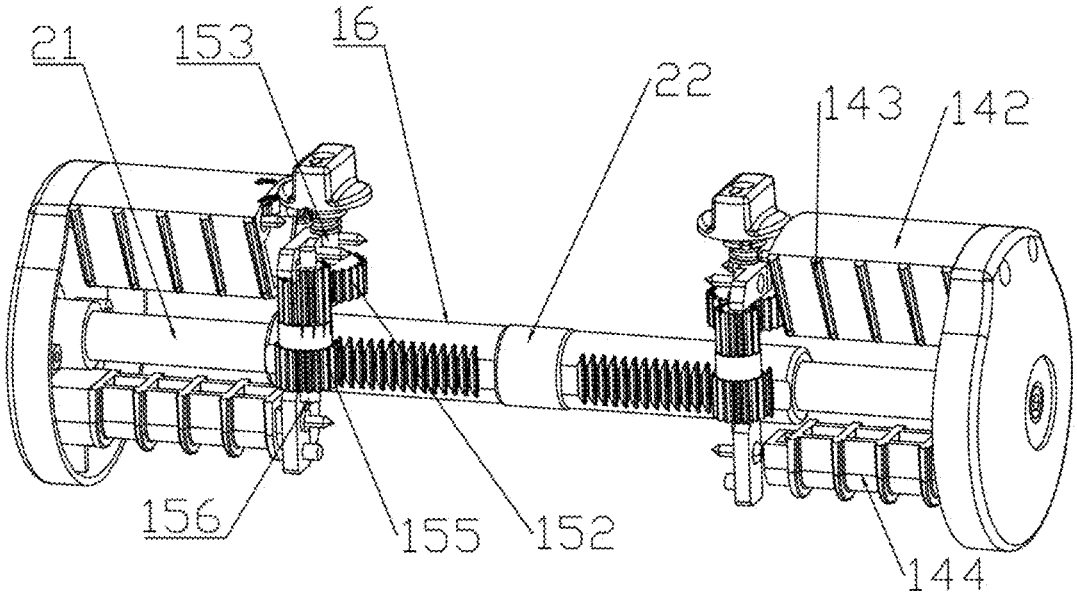
FIG. 3 is the principle diagram of the transmission adjusting structure in the Embodiment I of the application.

As shown in FIG. 3, the connecting rod 21 in the embodiment is provided with two telescopic sleeves 16, between which an isolation ring 22 is arranged in the fixed way in the middle of the connecting rod 21, and the periphery of the isolation ring 22 is in contact with the inner wall of the handle 2. The outer diameter of the isolation ring 22 is larger than that of the telescopic sleeves 16. By setting the isolation ring 22, the two telescopic sleeves 16 are separated, and by setting the length of the isolation ring 22, the contraction of the telescopic sleeves 16 can be limited. Furthermore, a gap is provided between the handle 2 and the connecting rod 21, which is served as the movement space for the telescopic sleeves 16.

Figure 4:
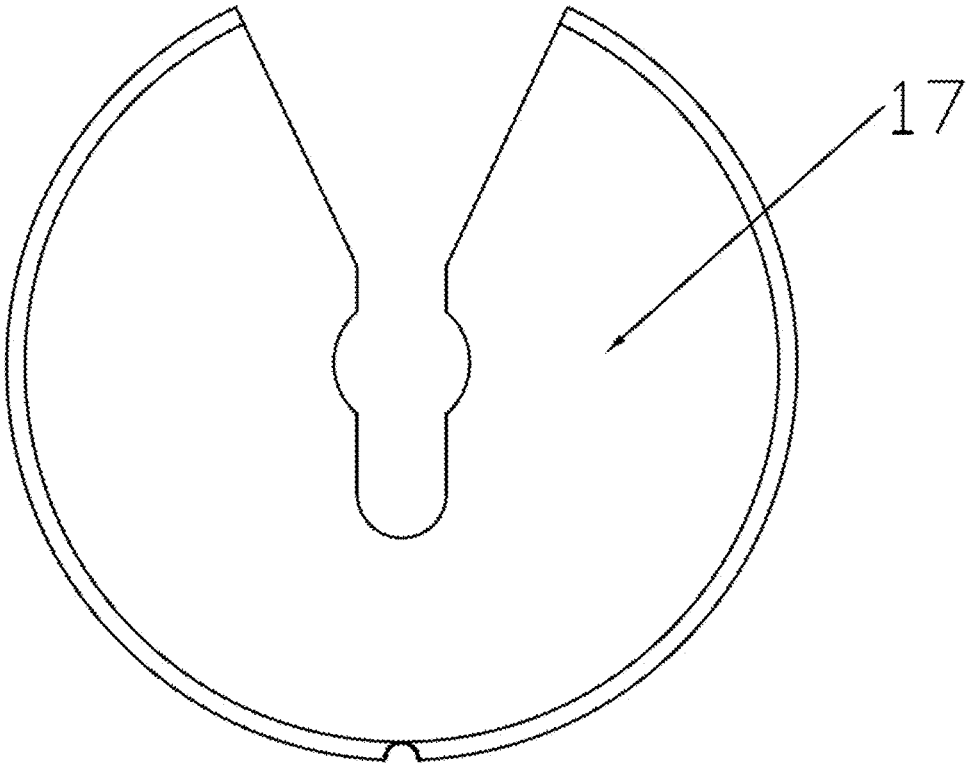
FIG. 4 is the schematic diagram of the counterweight in the Embodiment I of the application.

As shown in FIG. 4, the counterweight 17 is pie-shaped, with circular or equilateral polygonal (including regular hexagon) edge. A U-shaped notch and a central opening are provided on the counterweight 17, and the notch passes through the central opening; the width of the notch is matched with the diameter of the connecting rod 21, and the notch is used for passing the connecting rod 21; the diameter of the central opening is matched with the outer diameter of the telescopic sleeves 16. The diameter of the central opening is larger than the width of the gap, so that the telescopic sleeves 16 extend out and pass through the central opening to limit the counterweights 17, and the counterweights 17 can be lifted up along with the connecting rod 21 and the telescopic sleeves 16, while the counterweights 17 without central opening being passed by the telescopic sleeves 16 can be separated from the connecting rod 21 through the notch, to realize the adjustment of the counterweights. In order to place the connecting rod 21 into the notch of the counterweight 17 conveniently, the notch of the counterweight 17 is enlarged when approaching the edge, forming an opening structure shrinking from outside to inside.

Figure 5:
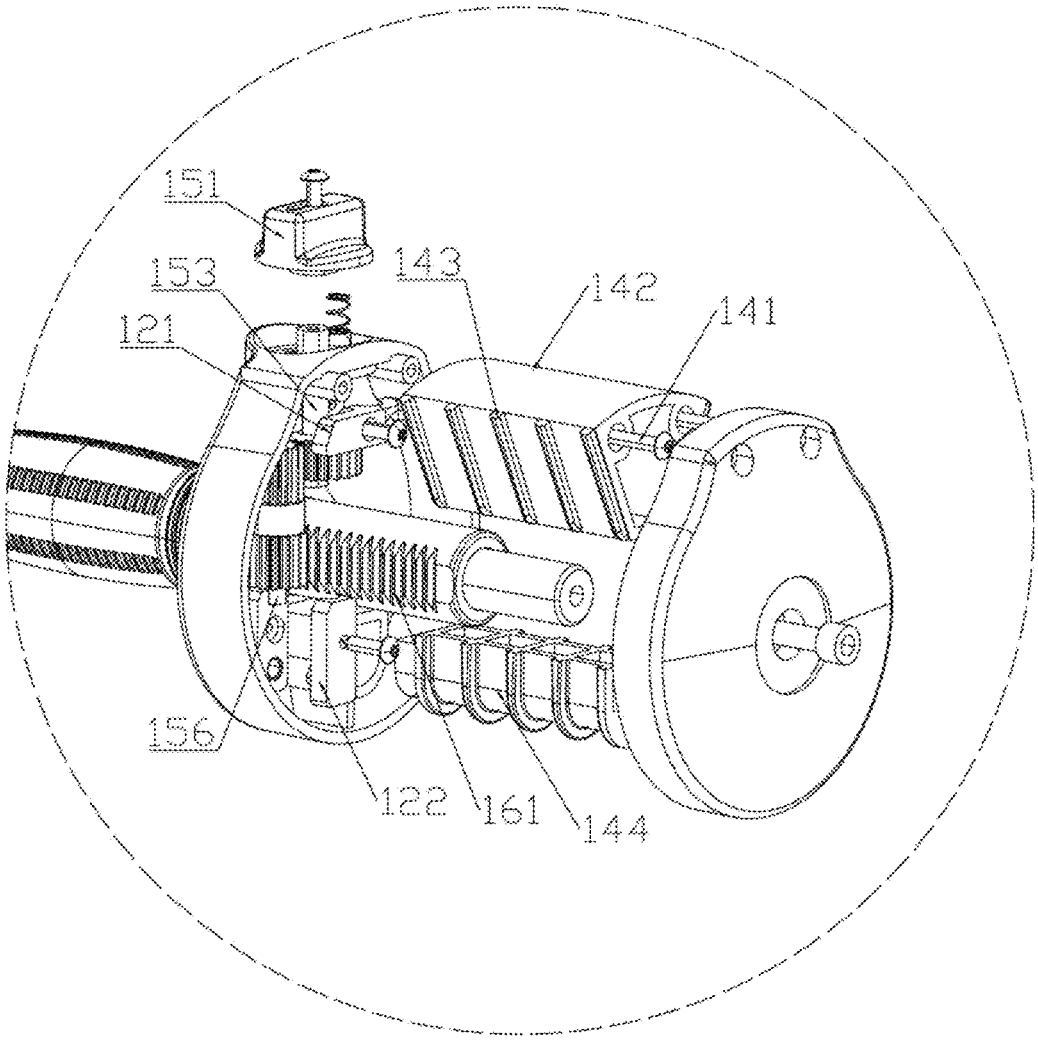
FIG. 5 is the partial enlarged view of FIG. 2 in the Embodiment I of the application.
Figure 6:
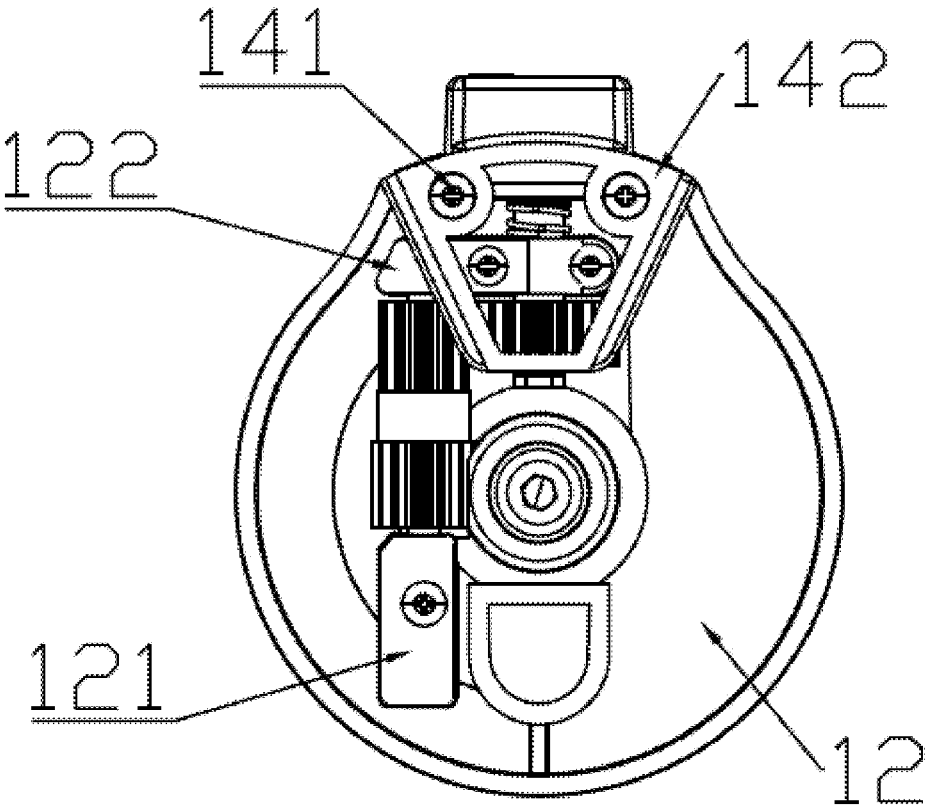
FIG. 6 is the schematic cross-sectional view of the straight rod casing in the Embodiment I of the application.
Figure 7:
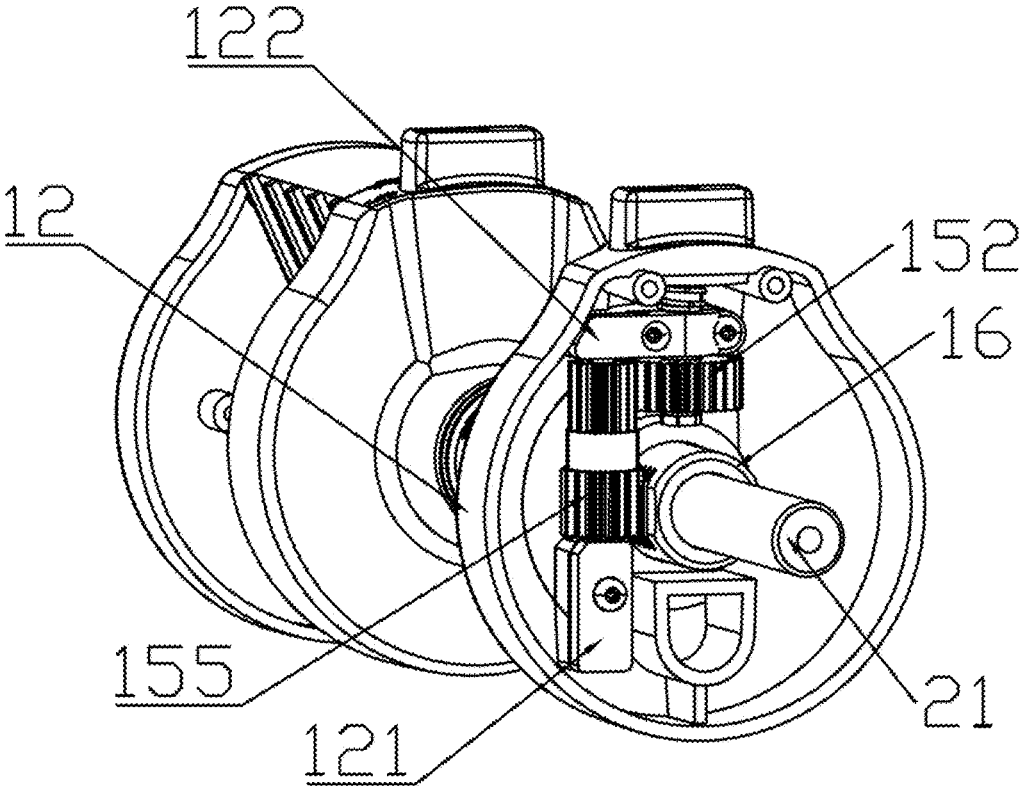
FIG. 7 is the connection diagram of the transmission adjusting structure in the Embodiment I of the application.

As shown in FIGS. 5-7, the casing 11 comprises an inner casing 12, an outer casing 13 and a connecting casing 14, wherein the inner casing 12 is sleeved with both ends of the connecting rod 21 near the handle 2, the outer casing 13 is fixedly arranged at both ends of the connecting rod 21, and the connecting casing 14 is arranged between the inner casing 12 and the outer casing 13 to realize the fixed connection between them. The connecting casing 14 comprises a straight rod 141 and a straight rod casing 142. The straight rod 141 is used to connect the inner casing 12 and the outer casing 13. The straight rod casing 142 is used to clad the straight rod 141, to avoid damage or corrosion of the connecting structure between the inner casing 12 and the outer casing 13, and also to heighten the aesthetic perception of the equipment. In this embodiment, the straight rod 141 passes through the opening provided in the outer casing 13 and is in threaded connection with the inner casing 12. In each counterweight adjusting module 1, two straight rods 141 are arranged between the inner casing 12 and the outer casing 13, which are parallel to each other to improve the connection strength. In this Embodiment, the cross section of the straight rod casing 142 along the direction perpendicular to the straight rod 141 is an inverted trapezoidal structure, of which the short side is arranged close to the connecting rod 21 and the long side is away from the connecting rod 21; on the other hand, as the counterweight 17 in this embodiment is in the shape of a round pie with arc edge, the long side of the straight rod casing 142 is arc-shaped to realize a smooth transition between the counterweight 17 and the straight rod casing 142. The outer surface of the straight rod casing 142 is provided with division bars 143, which are used to separate the counterweights 17 clamped on the telescopic sleeves 16. In this embodiment, the division bars 143 are arranged on the inclined plane corresponding to the two hypotenuses in the trapezoidal section of the straight rod casing 142. A straight rod 141 tube is also arranged in the straight rod casing 142 near two angles corresponding to the long side of the trapezoidal section; the inner diameter of the straight rod 141 tube is larger than the diameter of the straight rod 141, so that the straight rod 141 can easily extend into the straight rod 141 tube. The locations on the inner casing 12 and the outer casing 13 to arrange the straight rod 141 are provided with a convex cylindrical structure, the inside of which is used for arranging the straight rod 141, and the outside of which can be embedded in the straight rod 141 tube of the straight tube casing. Through the convex cylindrical structure on the inner casing 12 and the outer casing 13, both ends of the straight rod 141 tube of the straight rod casing 142 are connected to ensure the sealing effect on the straight rod 141 in the straight rod 141 tube. In this embodiment, the inner casing 12 is integrally made with the handle 2, and the outer casing 13 is fixedly connected with the connecting rod 21 through a screw structure. The screw structure includes screws, which pass through the screw holes on the outer casing 13 and are screwed with the two ends of the connecting rod 21 to realize the fixed connection between the outer casing 13 and the connecting rod 21. The side of the inner casing 12 close to the outer casing 13 is provided with a hollow structure, and the hollow part is used to set the transmission adjusting structure 15 to avoid interference with the counterweight 17 placed between the inner casing 12 and the outer casing 13. In this embodiment, the hollow part of the inner casing 12 is not sealed, so that the transmission adjusting structure 15 inside is exposed for convenience of replacement and maintenance. In some other embodiments, the hollow part of the inner casing 12 is correspondingly provided with a sealing cover, which seals the transmission adjusting structure between the inner casing 12 and the sealing cover, thereby protecting the transmission adjusting structure 15 and improving the visual effect.

The connecting casing 14 also comprises a bottom connecting column 144, which and the straight rod 141 are respectively arranged on the upper and lower sides of the connecting rod 21. Both ends of the bottom connecting column 144 are connected respectively with the inner casing 12 and the outer casing 13, and the inner casing 12 and the outer casing 13 are provided with protruding hollow columnar structures for connecting the bottom connecting column 144. The cross section of the bottom connecting column 144 is arched, which engages with the notch of the counterweight 17 in this embodiment for convenient fitting of the counterweight 17. The bottom connecting column 144 is also provided with a plurality of division bars 143. The division bars 143 on the bottom connecting column 144 are located corresponding to the division bars 143 on the straight rod casing 142. The division bars 143 in these two positions work together, separate the counterweights 17 on the upper and lower sides of the telescopic sleeves 16, and prevent them from sliding left and right when being nested on the telescopic sleeves 16.

Worm gear transmission or gear transmission is adopted between the transmission adjusting structure 15 and the telescopic sleeve 16. In this embodiment, gear transmission is adopted. The transmission adjusting structure 15 comprises a knob 151, a knob gear 152 and a transmission gear 155. The knob 151 is coaxially and fixedly connected with the knob gear. The transmission gear 155 includes an upper gear and a lower gear, wherein the upper gear is engaged with the knob gear 152, and the lower gear is connected with the telescopic sleeve 16. The side of the telescopic sleeve 16 close to the transmission gear 155 is provided with a latch 161, which is used to mesh with the lower gear of the transmission gear 155. It shall be noted that the length and spacing of the latch 161 on the side of the telescopic sleeve 16 are both set values, and linear grooves are arranged between the adjacent latches 161, which fit with the tooth crest of the lower gear, realizing the engaging of the latches 161 on the side of the telescopic sleeve 16 with the transmission gear 155, and avoiding the rotation of the telescopic sleeve 16 around the connecting rod 21. The transmission gear 155 is arranged on the inner casing 12, and a protruding mounting base I 121 and a protruding mounting base II 122 are arranged on the set positions of the inner casing 12. The mounting base 1121 and the mounting base II 122 are oppositely arranged, wherein the mounting base I 121 is located at the upper part of the mounting base II 122. A gear lever II 156 with transmission gear 155 is arranged between the mounting base 1121 and the mounting base 11122, and two gears are arranged on the gear lever 11156, which are respectively engaged with the knob gear 152 and the latch on the side of the telescopic sleeve 16 to realize transmission.

The mounting base 1121 comprises a seat I and a fixed cover I, wherein the fixed cover I is arranged on the seat I through threaded connection, and the seat I is integrally made with the inner casing 12. In order to avoid the rotation between the fixed cover I and the seat I, two screw connections are adopted in this embodiment. A through hole and a cylindrical hole are arranged on the connecting surface of the fixed cover I and the seat I, wherein the cylindrical hole is used for setting the gear rod I 153, so that the gear rod I 153 can be clamped when the seat I and the fixed cover I are connected and be removed when the two are separated. The through hole is used to pass the gear rod I 153 of the knob gear 152. One end of the gear rod I 153 extends out from the upper surface of the inner casing 12 and is fixedly connected with the knob 151, while the other end is connected with the knob gear 152.

The mounting base II 122 comprises a fixed cover II and a seat II. The seat II is integrally made with the inner casing 12. A threaded hole is provided on the seat II to realize the connection between the fixed cover II and the seat II. In order to maintain the positional relationship between the seat II and the fixed cover II, the seat II is provided with a cylindrical hole, and correspondingly, the fixed cover II is provided with a cylindrical protrusion, which is matched with the cylindrical opening to realize the front-to-front connection between the seat II and the fixed cover II. The side of the mounting base II 122 is provided with a cylindrical hole for setting the gear lever II 156. The cylindrical opening is arranged on the joint surface of the seat II and the fixed cover II, so that the gear lever II 156 can be clamped when the seat II and the fixed cover II are connected through screw threads, and removed when the two are separated.

Figure 8:
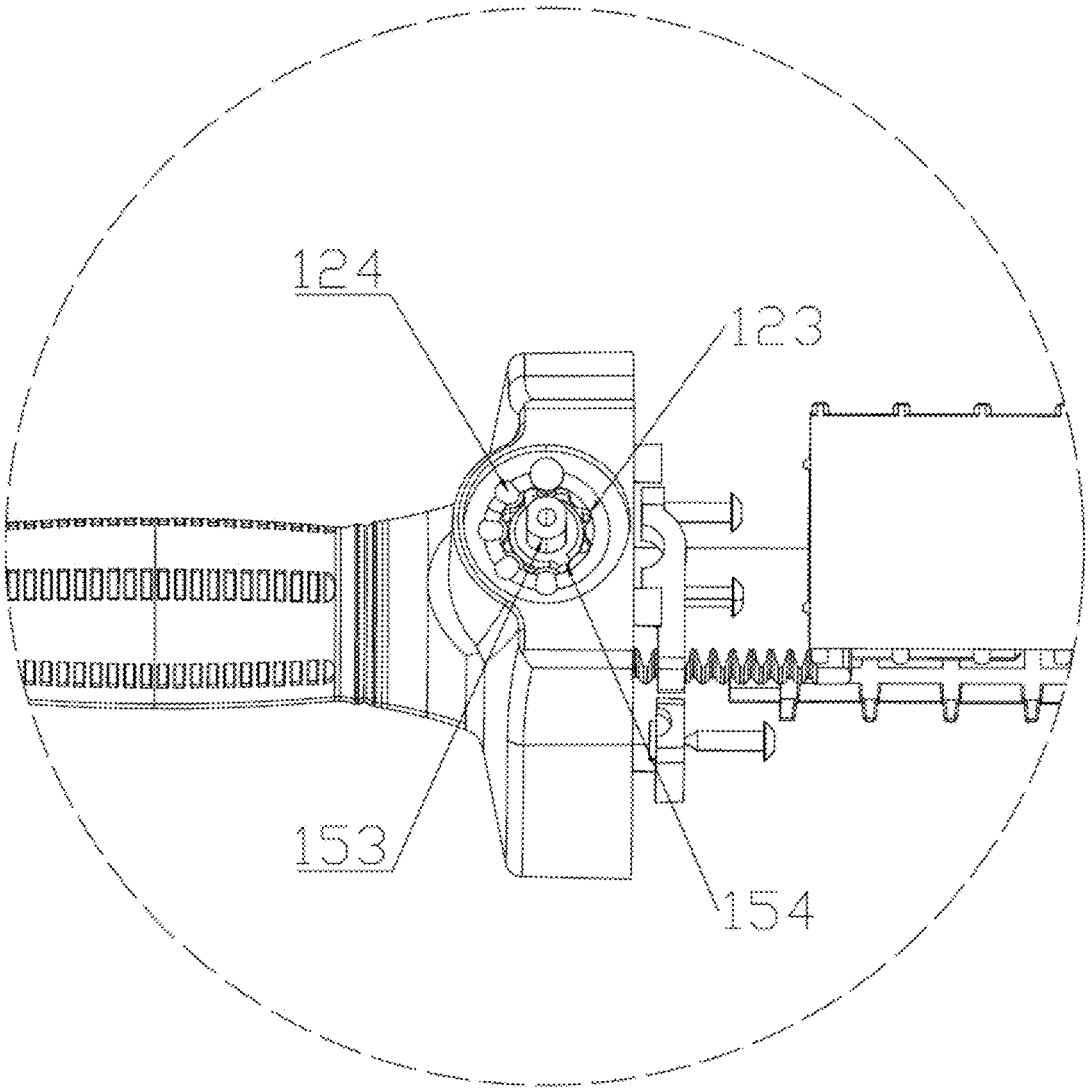
FIG. 8 is the connection diagram of the arc protrusion and the arc groove of the gear lever I in the Embodiment I of the application.

As shown in FIG. 8, in order to accurately control the extension length of the telescopic sleeves 16 for adjustment by grades, an arc protrusion 154 is arranged on the periphery of the gear lever I 153 at the part where the gear lever I 153 passes through the inner casing 12. Correspondingly, a plurality of arc-shaped grooves 123 are arranged on the side wall of the through hole on the inner casing 12 through which the gear lever passes. The shape of the arc-shaped grooves 123 is matched with the arc protrusions 154, so that when the gear lever 1153 moves up and down, the arc protrusions 154 on the periphery will pass through the arc-shaped grooves 123. When the arc protrusion 154 of the gear lever 1153 is embedded in the arc-shaped groove 123, the knob 151 is clamped and unable to rotate. Only after the arc protrusion 154 is removed from the arc-shaped groove 123 can the knob 151 be rotated. A spring is arranged between the gear lever 1153 and the mounting base 1121, which is used to apply upward elastic force to the gear lever I 153, so that the knob 151 keeps bounced in the natural state. At this time, the arc protrusion 154 is clamped in the arc-shaped groove 123 to prevent rotation of the knob 151. In this embodiment, a ball and a spring are also arranged between the knob 151 and the inner casing 12, and the lower surface of the knob 151 is provided with a cylindrical opening for arranging the spring and locking the ball. The upper surface of the part where the knob 151 is installed in the inner casing 12 is provided with a plurality of ball grooves 124, and the positions of the ball grooves 124 correspond to the arc grooves 123. Through the action of the ball, the spring and the ball grooves 124, rotate to feel the ball falling into the ball grooves 124 and the arc protrusion 154 corresponding to the arc-shaped groove 123 at this time, so that the arc protrusion 154 can be accurately clamped into the arc-shaped groove 123, thus providing more convenient rotation adjustment. In order to prevent falling out of the ball, the adjacent ball grooves 124 are connected in an arc depression way, so that the ball can roll between different ball grooves 124 along the arc depression. The knob 151 will be pressed down during adjustment, which will drive knob gear 152 downward. So, in the embodiment, the length of the knob gear 152 is less than that of the upper gear of the transmission gear 155, so that when the knob 151 is pressed down, the knob gear 152 and the transmission gear 155 remain effective engagement.

In order to further facilitate the control of the grades, grading characters, which are 5, 10, 15, 20 and 25 in this embodiment, are correspondingly arranged at the position with the knob 151 on the inner casing 12. It is difficult to know the connection between the transmission direction of the knob 151 and the movement direction of the telescopic sleeves 16 during the first use. This situation can be improved by setting the grading character.

Figure 9:
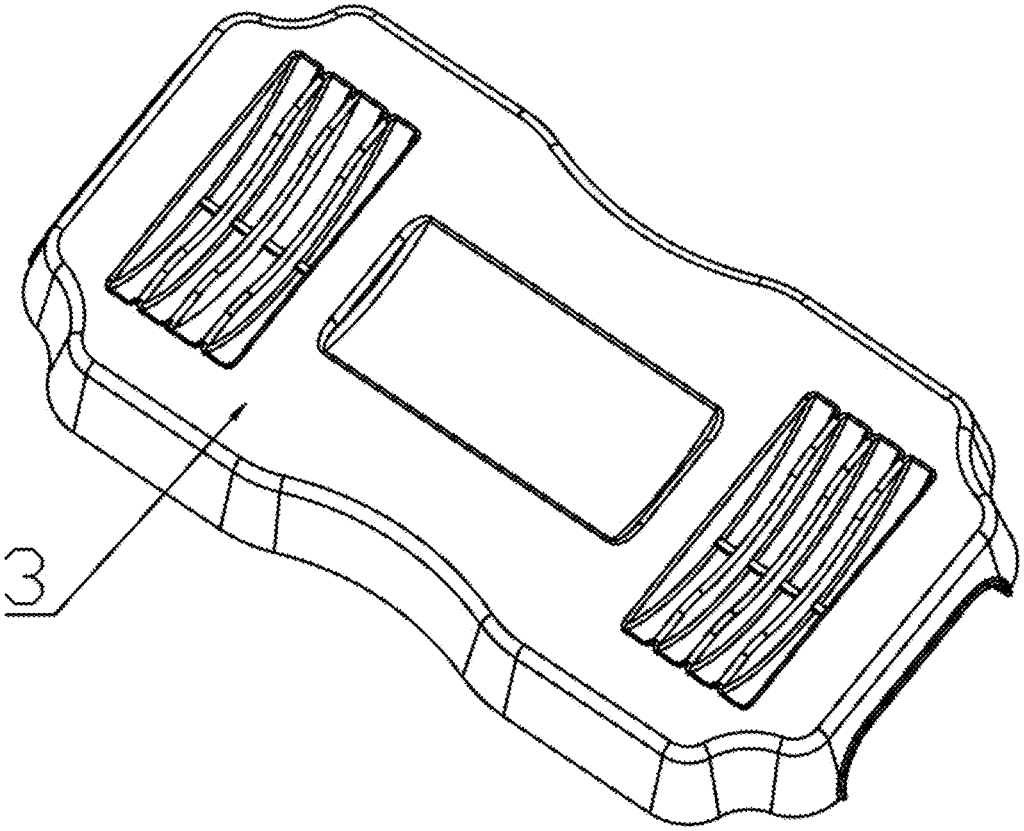
FIG. 9 is the schematic diagram of the seat in the Embodiment I of the application.

As shown in FIG. 9, the equipment also includes a seat 3, which is provided with grooves corresponding to the shape of the counterweights 17. The counterweights 17 and the casing 11 can be placed on the seat 3, which is convenient for storing and adjusting the counterweight. In order to ensure the position matching between the seat 3 and the counterweights 17, the seat 3 is provided with raised horizontal bars, and correspondingly, the bottom side of the counterweights 17 is provided with depressions that are matched with the horizontal bars, so that when the counterweights 17 are placed on the seat 3, the depressions will mesh with the horizontal bars to ensure the fitting between the counterweights 17 and the seat 3.

In order to facilitate grasping the handle 2, the periphery of the handle 2 is provided with patterns, and the part of the handle 2 that contacts with palm is made of elastic material with high friction coefficient, which is rubber material in this embodiment.

When the application is in use, the knob 151 in the transmission adjusting structure 15 can be adjusted to drive the telescopic sleeves 16 inside the handle 2 to move telescopically and control the telescopic length of the telescopic sleeves 16, so as to further control the number of counterweights 17 through which the telescopic sleeve 16 passes, thereby realizing the adjustment of counterweight. Meanwhile, owing to the position limitation of the division bars 143, the counterweights 17 will not slide left or right, thus ensuring the firm coupling.

The above description is only the preferred embodiment of the application and does not constitute any limitation on the application. Obviously, for those skilled in the art, after understanding the content and principle of this application, it is possible to make various modifications and changes in form and details without deviating from the principle and structure of the application. However, these modifications and changes based on the idea of the application are still within the scope of protection of the claims of the application.

What is claimed is:

1. A dumbbell convenient for adjusting a load thereof, the dumbbell comprising:

a handle being hollow inside and comprising a connecting rod arranged therein, the connecting rod penetrating through the handle along an axial direction thereof, and opposing ends of the connecting rod respectively extending out from opposing ends of the handle; and two counterweight adjustment modules symmetrically arranged, connected through a handle, and used for adjusting the load;

wherein the two counterweight adjustment modules are respectively connected to the opposing ends of the connecting rod respectively extending out from the opposing ends of the handle;

each counterweight adjustment module comprises a casing, a transmission adjusting structure, a telescopic sleeve, and a plurality of counterweights, wherein:

the casing is arranged at a corresponding one end of the handle;

the telescopic sleeve is arranged on and can slide along the connecting rod; and the transmission adjusting structure is arranged inside the casing, and is transmissibly connected with the telescopic sleeve for controlling an extension length of the telescopic sleeve;

wherein the casing comprises an inner casing, an outer casing and a connecting casing; wherein the inner casing is sleeved with the corresponding one end of the connecting rod near the handle, the outer casing is fixedly arranged at the corresponding one end of the connecting rod, and the connecting casing is arranged between the inner casing and the outer casing to realize a fixed connection between the inner and outer casings;

wherein the transmission adjusting structure comprises a knob, a knob gear and a transmission gear; the knob is coaxially and fixedly connected with the knob gear; the transmission gear comprises an upper gear and a lower gear, wherein the upper gear engages with the knob gear and the lower gear is connected with the telescopic sleeve; a latch is arranged on one side of the telescopic sleeve close to the transmission gear for meshing with the lower gear of the transmission gear; the knob gear is connected with the inner casing through a first mounting seat, a first gear lever of the knob gear passes through the first mounting seat, and the knob gear is also fixedly connected with the knob through the first gear lever; the transmission gear is connected with the inner casing through a second mounting seat, and a second gear lever of the transmission gear is mounted on the second mounting seat.

2. The dumbbell as set forth in claim 1, wherein a gap is provided between the connecting rod and an inner wall of the handle, which serves as a movement space for the two telescopic sleeves.

3. The dumbbell as set forth in claim 1, wherein the connecting rod is provided with the two telescopic sleeves; an isolation ring is arranged between the two telescopic sleeves, and the isolation ring is fixed in a middle of the connecting rod; a periphery of the isolation ring is in contact with an inner wall of the handle; and an outer diameter of the isolation ring is larger than an outer diameter of each of the two telescopic sleeves.

4. The dumbbell as set forth in claim 1, wherein each of the plurality of counterweights is pie-shaped, with a circular or equilateral polygonal edge; a U-shaped notch and a central opening are provided on each counterweight, and the U-shaped notch passes through the central opening; a width of the U-shaped notch is matched with a diameter of the connecting rod, and the U-shaped notch is dimensioned to receive the connecting rod; and a diameter of the central opening is matched with an outer diameter of each of the two telescopic sleeves.

5. The dumbbell as set forth in claim 4, wherein the U-shaped notch of each counterweight is enlarged when approaching the circular or equilateral polygonal edge, forming an opening structure in each of the plurality of counterweights, the opening structure having dimensions that are tapered from the circular or equilateral polygonal edge towards the central opening.

6. The dumbbell as set forth in claim 1, wherein:

an outer periphery of the first gear lever is provided with an arc protrusion at a position where the first gear lever passes through the inner casing;

correspondingly, on the inner casing, a plurality of arc grooves are arranged on a side wall of a through-hole through which the gear lever passes, and shapes of the plurality of arc grooves are matched with the arc protrusion;

a first spring is arranged between the first gear lever and the first mounting seat;

a ball and a second spring are arranged between the knob and the inner casing, and a lower surface of the knob is provided with a cylindrical opening for arranging the second spring and locking the ball; and an upper surface of a part where the knob is installed on the inner casing is provided with a plurality of ball grooves, and positions of the plurality of ball grooves respectively correspond to the plurality of arc grooves.

7. The dumbbell as set forth in claim 1, the connecting casing comprising:

a straight rod, which is used for connecting the inner casing and the outer casing, wherein the straight rod passes through an opening on the outer casing and is in threaded connection with the inner casing;

a straight rod casing used for cladding the straight rod, wherein two ends of the straight rod casing are respectively connected with the inner casing and the outer casing;

a bottom connecting column arranged together with the straight rod casing adjacent to lower and upper sides of the connecting rod, respectively, wherein two ends of the bottom connecting column are respectively connected with the inner casing and the outer casing; and a plurality of division bars respectively arranged on the straight rod casing and the bottom connecting column, which are used for dividing each of the plurality of counterweights nested on the telescopic sleeve.

* * * * *